US007817101B2

(12) United States Patent
Cowles

(10) Patent No.: US 7,817,101 B2
(45) Date of Patent: Oct. 19, 2010

(54) DUAL POLARIZED MULTIFILAR ANTENNA

(75) Inventor: Philip R. Cowles, Cambridge (CA)

(73) Assignee: Com Dev International Ltd., Cambridge (CA)

( * ) Notice: Subject to any disclaimer, the term of this patent is extended or adjusted under 35 U.S.C. 154(b) by 395 days.

(21) Appl. No.: 11/875,547

(22) Filed: Oct. 19, 2007

(65) Prior Publication Data

US 2008/0094308 A1 Apr. 24, 2008

Related U.S. Application Data

(63) Continuation-in-part of application No. 11/585,147, filed on Oct. 24, 2006, now abandoned.

(51) Int. Cl.
*H01Q 1/36* (2006.01)

(52) U.S. Cl. ..... 343/895

(58) Field of Classification Search ..... 343/895
See application file for complete search history.

(56) References Cited

U.S. PATENT DOCUMENTS

| | | | |
|---|---|---|---|
| 3,503,075 A | 3/1970 | Gerst | |
| 3,906,509 A | 9/1975 | DuHamel | |
| 3,913,109 A | 10/1975 | Owen | |
| 3,940,772 A | 2/1976 | Ben-Dov | |
| 4,011,567 A | 3/1977 | Ben-Dov | |
| 5,170,176 A | 12/1992 | Yasunaga et al. | |
| 5,255,005 A | 10/1993 | Terret et al. | |
| 5,708,448 A | 1/1998 | Wallace | |
| 5,909,196 A | 6/1999 | O'Neill, Jr. | |
| 5,986,619 A | 11/1999 | Grybos et al. | |
| 6,025,816 A | 2/2000 | Dent et al. | |
| 6,137,996 A | 10/2000 | Baumann | |
| 6,150,994 A | 11/2000 | Winter et al. | |
| 6,185,427 B1 | 2/2001 | Krasner et al. | |
| 6,222,505 B1 * | 4/2001 | Endo et al. | 343/895 |
| 6,236,354 B1 | 5/2001 | Krasner | |

(Continued)

FOREIGN PATENT DOCUMENTS

| | | |
|---|---|---|
| EP | 0666612 | 9/1995 |

(Continued)

OTHER PUBLICATIONS

Office Action from the related U.S. Appl. No. 11/585,147 dated Mar. 19, 2008.

(Continued)

*Primary Examiner*—HoangAnh T Le
(74) *Attorney, Agent, or Firm*—Bereskin & Parr LLP; Isis E. Caulder

(57) ABSTRACT

Various embodiments are described of an antenna including a common ground plane, a first set of N approximately resonant elements with a length l2 and a second set of M approximately resonant elements with a length l1. The first set of N approximately resonant elements are wound to form a first helix with an initial diameter d2 and a height h2. The second set of M approximately resonant elements are wound in the opposite direction to the first set of N approximately resonant elements to form a second helix. The second helix is centrally disposed within the first helix, and d1 is less than d2 and h1 is greater than h2.

20 Claims, 15 Drawing Sheets

U.S. PATENT DOCUMENTS

| | | | | |
|---|---|---|---|---|
| 6,271,804 | B1 | 8/2001 | Yanagisawa et al. | |
| 6,400,339 | B1 | 6/2002 | Edvardsson et al. | |
| 6,414,648 | B1 | 7/2002 | Holland et al. | |
| 6,427,121 | B2 | 7/2002 | Brodie | |
| 6,476,776 | B1 | 11/2002 | Kurby | |
| 6,522,301 | B2 | 2/2003 | Takayama et al. | |
| 6,535,179 | B1 | 3/2003 | Petros | |
| 6,545,649 | B1 | 4/2003 | Seavey | |
| 6,587,081 | B2 | 7/2003 | Noro et al. | |
| 6,611,757 | B2 | 8/2003 | Brodie | |
| 6,658,349 | B2 | 12/2003 | Cline | |
| 6,738,026 | B1 * | 5/2004 | McKivergan et al. | 343/895 |
| 6,816,127 | B2 | 11/2004 | McKivergan et al. | |
| 6,823,170 | B1 | 11/2004 | Dent | |
| 6,940,471 | B2 | 9/2005 | Smith | |
| 7,047,114 | B1 | 5/2006 | Rogers | |
| 7,133,810 | B2 | 11/2006 | Butler et al. | |
| 7,205,933 | B1 | 4/2007 | Snodgrass | |
| 2004/0108964 | A1 * | 6/2004 | McKivergan et al. | 343/895 |
| 2004/0193367 | A1 | 9/2004 | Cline | |
| 2004/0217900 | A1 | 11/2004 | Martin et al. | |
| 2005/0124291 | A1 | 6/2005 | Hart et al. | |
| 2006/0199612 | A1 | 9/2006 | Beyer et al. | |
| 2006/0290590 | A1 | 12/2006 | Takaoka et al. | |
| 2008/0086267 | A1 | 4/2008 | Stolte et al. | |
| 2008/0088485 | A1 | 4/2008 | Stolte et al. | |
| 2008/0094307 | A1 | 4/2008 | Cowles | |

FOREIGN PATENT DOCUMENTS

| | | |
|---|---|---|
| WO | WO97/42682 | 11/1997 |
| WO | WO9828814 | 7/1998 |
| WO | WO0209318 | 1/2002 |
| WO | WO2004010572 | 1/2004 |
| WO | WO2007143478 | 12/2007 |

OTHER PUBLICATIONS

Comments to the National Telecommunications and Information Administration published Dec. 1, 2006.

Hoye et al., Space-based AIS for global maritime traffic monitoring, Acta Astronautica 62 (2008), pp. 240-245, available online Sep. 17, 2007.

U.K. Search Report dated Jan. 1, 2008.

Lowdell et al., Dual Band Quadrifilar Helix Antennas for UHF/VHF Band Operation, Antennas and Propagation, Twelfth International Conference on; vol. 1, Mar. 31-Apr. 3, 2003, pp. 180 -185, entire document.

PCT International Search Report and Written Opinion mailed on Aug. 4, 2008.

P.R. Cowles, "Studies of millimeter wave aerials", University of Kent, PhD thesis, 1973.

International Preliminary Report on Patentability, International Application No. PCT/CA2008/000736, dated Apr. 20, 2010.

* cited by examiner

DUAL POLARIZED MULTIFILAR ANTENNA

CROSS-REFERENCE TO RELATED APPLICATION

This application is a continuation-in-part application and claims priority from U.S. patent application Ser. No. 11/585,147 filed on Oct. 24, 2006.

FIELD

The embodiments described herein relate to helical antennas and in particular an antenna comprised of multifilar helical elements operable at the same frequency simultaneously.

BACKGROUND

When receiving radio signals, it is necessary to use an antenna that not only operates over the frequency range that the signals occupy, but that also matches the nature of the polarization of those signals. As is known to those skilled in the art, polarization describes the direction of the electrical field component of an electromagnetic (EM) wave, as it arrives at the receiving antenna. The electrical field component of an EM wave can be subdivided into a horizontal component and a vertical component.

If the electrical field component of the wave has only one subcomponent, either a horizontal component or a vertical component, then the wave is said to have linear polarization. If the wave has both subcomponents the signal is said to have elliptical polarization. If the horizontal and vertical components are equal in magnitude and differ in phase by 90°, the wave is said to be circularly polarized. Either type of polarization, linear or elliptical, can provide two orthogonal signals at the same frequency. For example, a linear polarized signal can either propagate with its polarization in the horizontal direction or the vertical direction; and a circularly polarized signal can either be right-handed or left-handed, depending on the direction the electrical field vector rotates.

An antenna that is simultaneously operable in both orthogonal polarizations is advantageous because using each orthogonal polarization to independently carry data may double the capacity of a communications channel. In addition to increasing the capacity of a communications channel, polarization of a radio signal can be used to maximize the strength of a received signal by matching the antenna to the incoming polarization. It can also be used to eliminate an unwanted signal by setting the receive antenna to be orthogonal to the unwanted signal.

Dual polarized antennas have been realized in several different fundamental antenna forms such as dipole type antennas, waveguide-type antennas, reflector-type or lens antennas and helical antennas. Helical antennas, in particular, are well suited for satellite applications because they have a relatively large bandwidth and since it is possible to stow them in a small volume. A helical antenna typically consists of a conducting wire wound in the form of a helix and mounted over a ground plane. The helical antenna can operate in either normal or axial mode. In axial mode, the helical antenna is a natural radiator of circularly polarized radiation and can be configured to provide both hands of operation. FIG. 1 illustrates an isometric view of a typical axial mode helical antenna 5.

A common form of dual-polarized helical antenna is a dual polarized single-wire helix antenna. FIG. 2 illustrates a side view of a typical dual polarized single-wire helix antenna. The antenna 10 is comprised of a single wire helix 12, a reflector or ground plane 14, a lower end coaxial feed 16 and a far end feed 18. When the antenna 10 is fed from the lower end 16 the polarization is defined by the handedness of the single-wire helix 12. When the antenna 10 is fed at the far end 18, the helix 12 radiates its own particular hand of polarization, but this is reversed when reflected by the ground plane 14.

The most significant operational constraint of the dual polarized single-wire helix antenna 10 is its size. The antenna 10 will only radiate circular polarization in the axial mode when its circumference is about one wavelength (λ). Furthermore, the ground plane 14 must be sufficiently large to support successful wave propagation on the single-wire helix 12, and this can typically be larger than a wavelength (λ) across.

Attempts to design dual polarized forms of helical antennas have failed generally because the coupling between the two structures destroys the performance of both, or introduces a very high degree of electrical coupling between the two antennas or antenna elements.

SUMMARY

In one aspect, at least one embodiment described herein provides an antenna comprising a common or shared ground plane; a first set of N approximately resonant elements associated with the common ground plane, each of said first set of approximately resonant elements having a length l2 and wound to form a first helix with an initial diameter d2 and a height h2; and a second set of N approximately resonant elements associated with the common ground plane. Each of said second set of approximately resonant elements have a length l1 and are wound in the opposite direction to the first set of approximately resonant elements to form a second helix that is centrally disposed within the first helix, and has an initial diameter d1 and a height h1 where d1 is less than d2 and h1 is greater than h2.

In another aspect, at least one embodiment described herein provides a dual polarized multifilar antenna comprising a ground plane; a first set of N resonant elements coupled to the ground plane and wound to form a first helical antenna; and a second set of M resonant elements coupled to the ground plane and wound in an opposite direction to the first set of resonant elements to form a second helical antenna. The first and second helical antennas are concentric, have different heights and diameters, the resonant elements of both helical elements have similar lengths, and the helical antennas are operable at substantially similar frequencies simultaneously.

In both cases, N and M are integers with values greater than or equal to three.

Further aspects and features of the embodiments described herein will appear from the following description taken together with the accompanying drawings.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
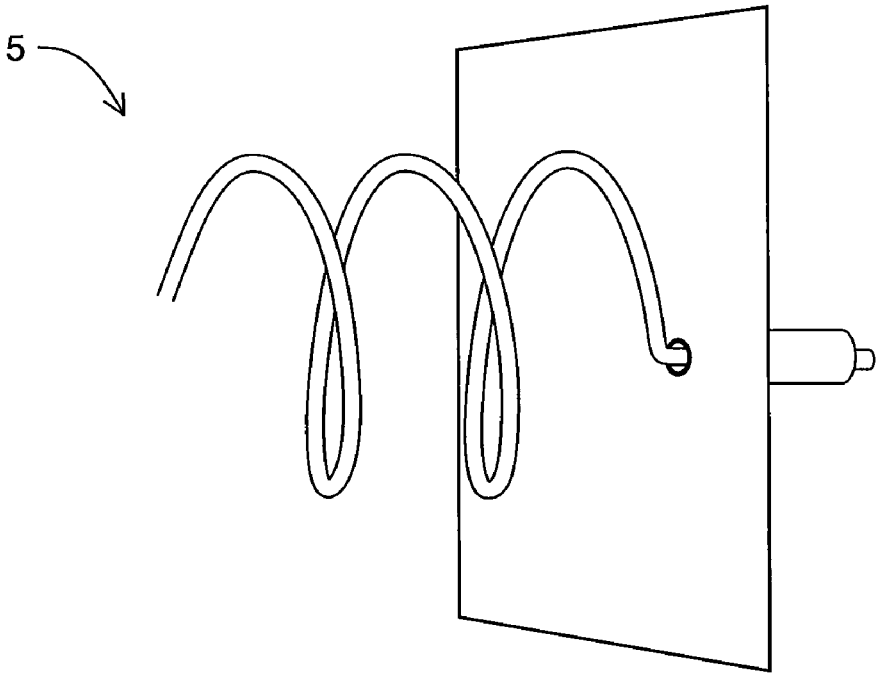
FIG. 1 PRIOR ART
FIG. 1 is an isometric view of a typical prior art axial mode single-wire helical antenna.
Figure 2:
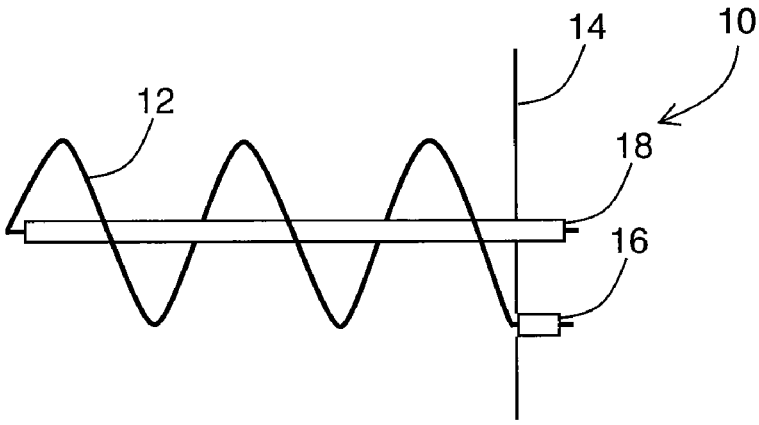
FIG. 2 PRIOR ART
FIG. 2 is a side view of a typical prior art dual polarized single-wire helical antenna.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

Figure 3:
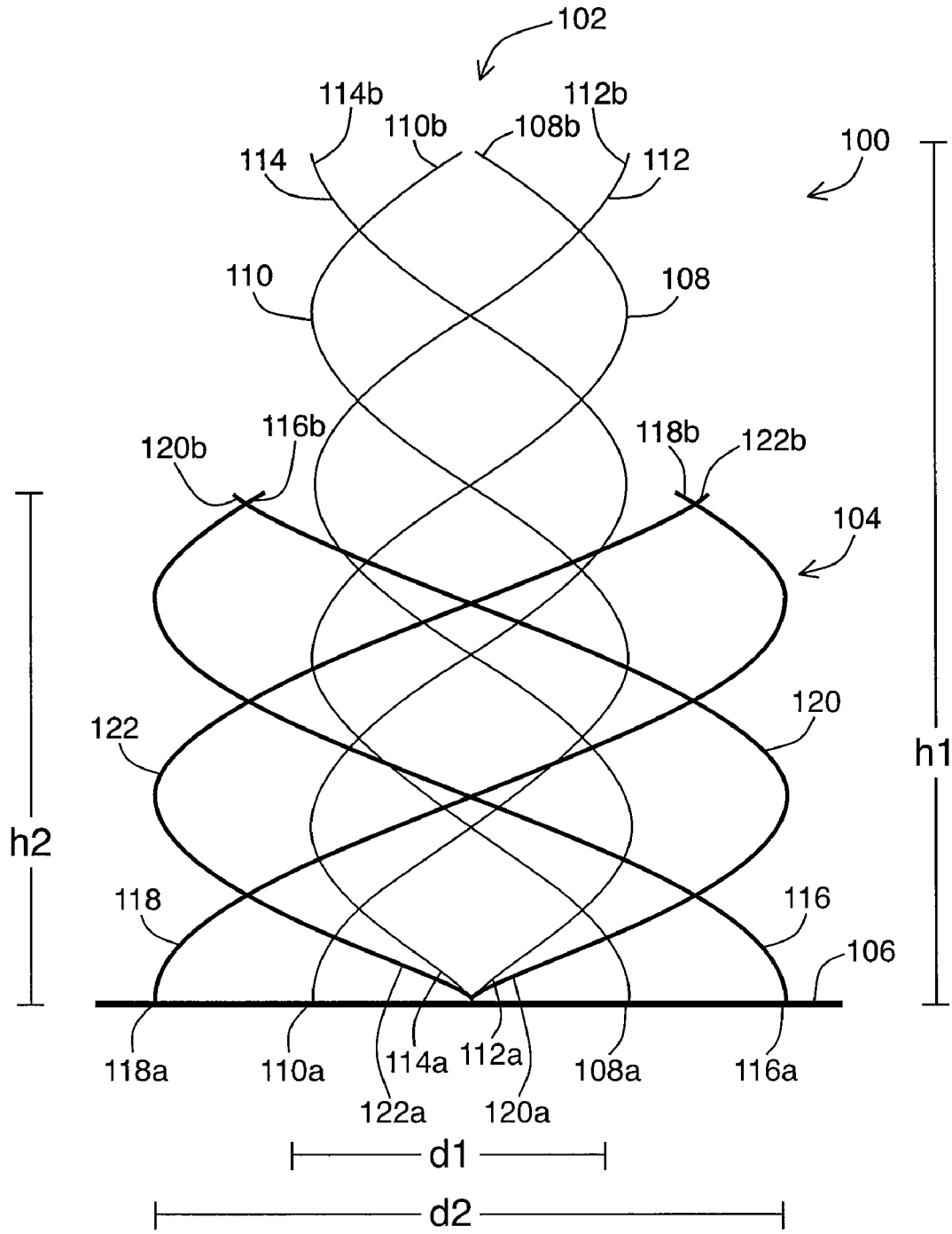
FIG. 3 is a side view of an exemplary embodiment of a dual polarized quadrifilar antenna.
Figure 4:
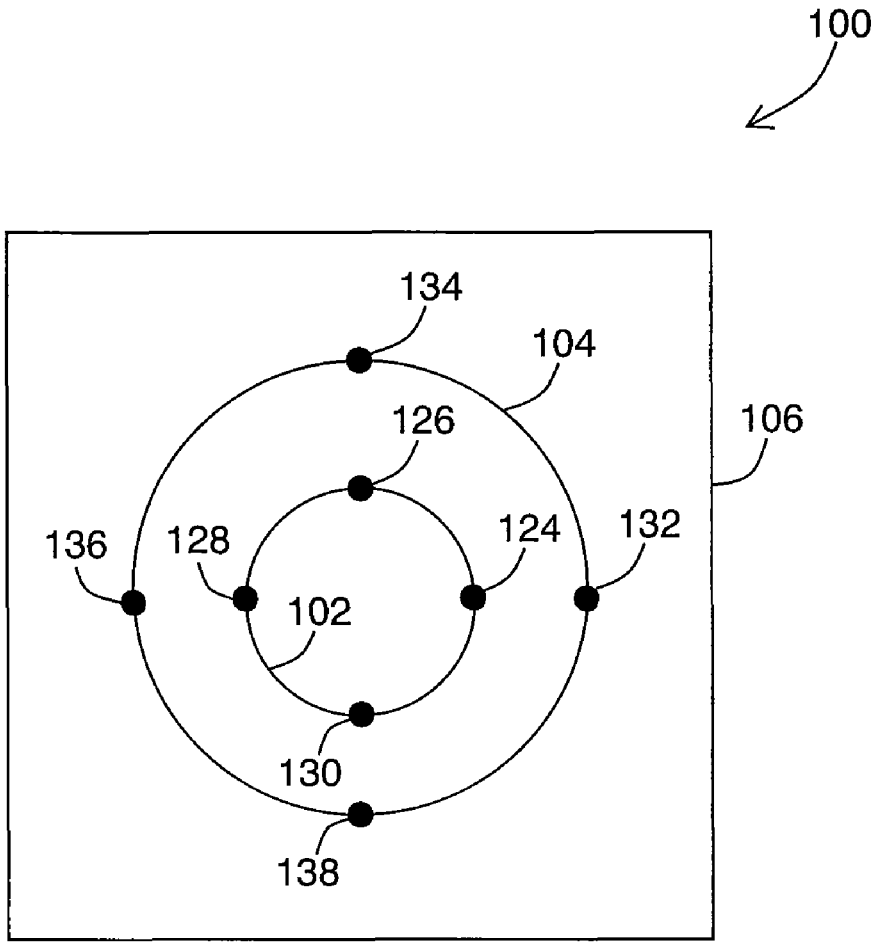
FIG. 4 is a top view of an exemplary embodiment of a dual polarized quadrifilar antenna.

Reference is first made to FIGS. 3 and 4 that show a side view and a top view of an exemplary embodiment of a dual polarized multifilar antenna 100, respectively. The antenna 100 includes an inner multifilar helix 102, an outer multifilar helix 104 and a common ground plane 106. The inner helix 102 is placed concentrically within the outer helix 104 over the common ground plane 106. The inner and outer helices 102 and 104 form independent oppositely polarized antennas that are simultaneously operable at the same frequency (f).

Figure 5:
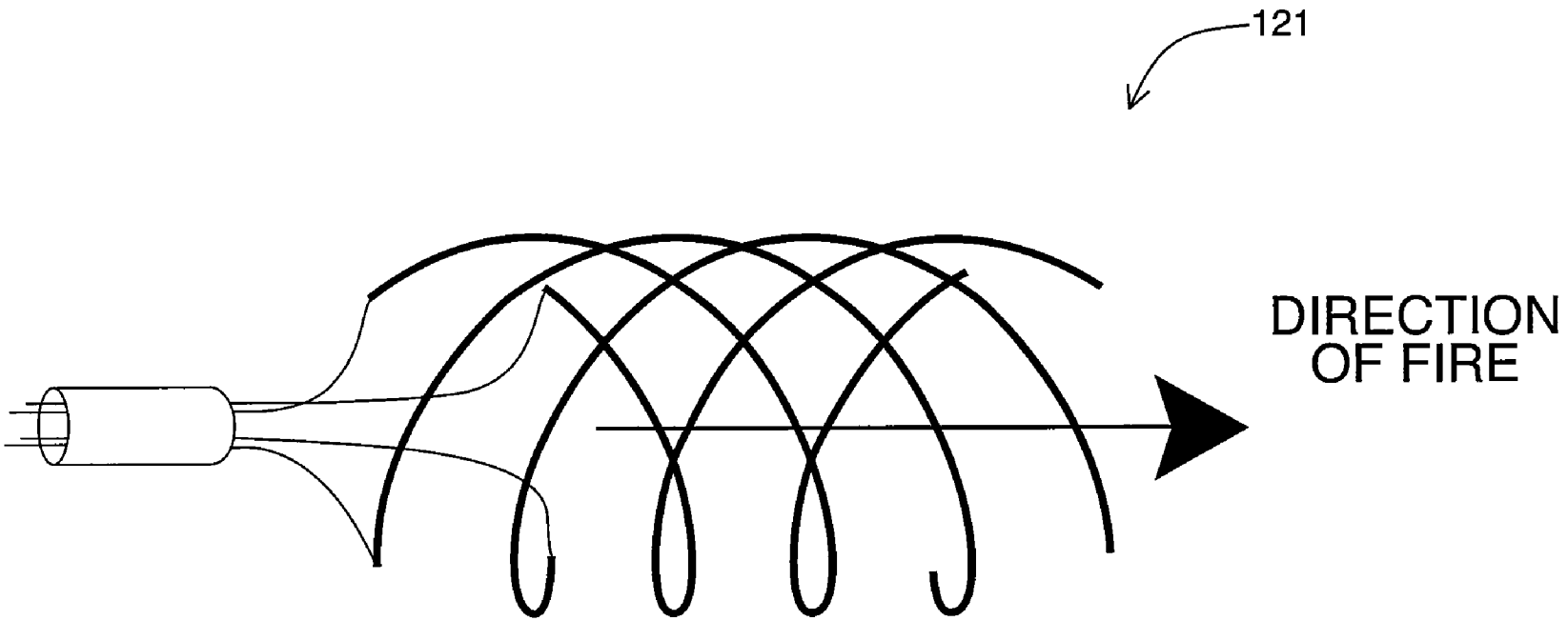
FIG. 5 is an isometric view of a typical quadrifilar antennae fed by balanced transmission lines.

It should be understood that while a common or shared reflector is utilized in the present embodiment in place of the common ground plane 106, various other devices can be used in place of the common ground plane 106. For example, a balanced feed network such as a quad-balanced transmission line configured so that the inner multifilar helix 102 and the outer multifilar helix 104 are properly fed can be used instead. Generally speaking, use of a ground plane is beneficial in the case where maximum forward gain is required (e.g. in spacecraft applications). However, for example, in mobile applications it is more desirable to have a wider, more omni-directional coverage pattern and accordingly another device such as the quad-balanced transmission line discussed above can be used. FIG. 5 shows an isometric view of a typical quadrifilar antenna 121 fed by balanced transmission lines where the direction of fire is indicated along its axis as shown.

Also, in some applications, it should be understood that it may be convenient to feed either the inner or outer multifilar helix 102 or 104 in one manner, and the other of the inner or outer multifilar helix 102 or 104 in another manner. For instance, if there was tightly restricted space around the base of the outer multifilar helix 104, it can be fed using a 4-wire quad feed, while the inner multifilar helix 102 can be fed with a conventional ground plane. Of course, the reverse can also apply.

The multifilar helices 102 and 104 are each comprised of N identical resonant elements or "filars" where N is greater than or equal to four. While the filars are referred to as "resonant" elements it is not essential that the elements be strictly resonant, it is sufficient if they are approximately resonant or within ±20% of resonance. In the exemplary embodiment shown in FIGS. 3 and 4 the helices 102 and 104 are each comprised of four resonant elements 108, 110, 112, 114 and 116, 118, 120, 122 respectively. Each resonant element has a first end 108*a*, 110*a*, 112*a*, 114*a*, 116*a*, 118*a*, 120*a*, 122*a* and a second end 108*b*, 110*b*, 112*b*, 114*b*, 116*b*, 118*b*, 120*b*, 122*b*. The resonant elements 108, 110, 112, 114, 116, 118, 120, and 122 may be implemented as wires made out of electrically conductive material such as copper, copper-plated steel, beryllium-copper, plated plastic of composite material, or conductive polymers, and the like.

The gauge of the resonant elements 108, 110, 112, 114, 116, 118, 120, and 122 is dictated by two constraints: (1) the resonant elements must be of a sufficient gauge so as not to incur excessive resistive losses; and (2) the resonant elements must be thin enough so that there is not an unacceptable degree of capacitive coupling that would render the antenna inoperable. The resonant elements 108, 110, 112, 114, 116, 118, 120, and 122 may have a constant gauge or may be tapered.

Figure 6:
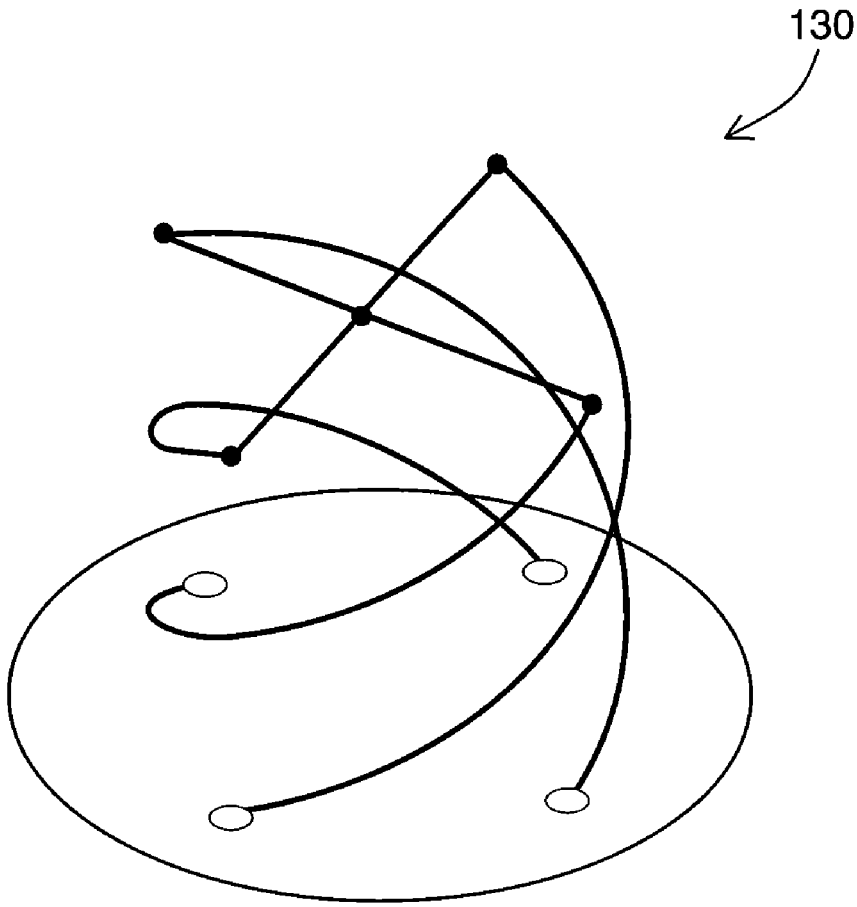
FIG. 6 is an isometric view of a typical prior art short-circuited quadrifilar helix.

The length of the resonant elements is dictated approximately by the frequency (f) at which the antenna operates and whether the antenna is a short or open-circuited helical antenna. In an open-circuited antenna, the second ends of the resonant elements 108*b*, 110*b*, 112*b*, 114*b*, 116*b*, 118*b*, 120*b*, 122*b* are open-circuited as in FIG. 3. In a short-circuited antenna the second ends of the resonant elements 108*b*, 110*b*, 112*b*, 114*b*, 116*b*, 118*b*, 120*b*, 122*b* are short-circuited to each other via conductive elements. In short-circuited helical antennas the resonant elements are typically shorted to each other by crossing the elements to form a star configuration. FIG. 6 shows an isometric view of a typical short-circuited quadrifilar antenna 130.

However, this short-circuit technique cannot be used for a dual polarized multifilar antenna as described herein because the star configuration of the outer helix 104 would interfere with the inner helix 102. An alternative technique for shorting the outer resonant elements 116, 118, 120, and 122 such as using a rigid ring extending around the inner helix 102 to which all of the outer resonant elements 116, 118, 120, and 122 are attached can be used.

For an open-circuited multifilar antenna the lengths of the individual resonant elements 108, 110, 112, 114, 116, 118, 120, and 122 are approximately equal to a multiple of half-wavelengths ($\lambda/2$) where the wavelength ($\lambda$) is inversely proportional to the operating frequency (f). Accordingly, the smallest open-circuited multifilar antenna operating at 300 MHz (a wavelength ($\lambda$) of 1 meter) requires resonant element lengths of approximately 0.5 meters. For a short-circuited multifilar antenna the length of the resonant elements is approximately equal to a multiple of quarter wavelengths ($\lambda/4$). A $\lambda/4$ short-circuited antenna would clearly be a smaller antenna than a $\lambda/2$ open-circuited antenna, but the short-circuited antenna would require additional parts and joints to connect the resonant elements and would have less gain. The resonant element lengths are not exact multiples of a half-wavelength ($\lambda/2$) or a quarter-wavelength ($\lambda/4$) due to the fact that the wave will propagate along a resonant element at less than the speed of light due to the presence of the other resonant element and the coupling of energy to the free-space wave.

In the exemplary embodiment shown in FIGS. 3 and 4 the length of the resonant elements 108, 110, 112, 114, 116, 118, 120, and 122 is approximately equal to a half-wavelength ($\lambda/2$). In the case where both the inner and outer resonant elements are of equal nominal length, their performance (i.e. radiation pattern and gain profile) will be similar if not very closely related. However, it is not necessary that the length of the inner resonant elements 108, 110, 112, 114, be equal to the length of the outer resonant elements 116, 118, 120, and 122. The length of the inner resonant elements 108, 110, 112, and 114 may be a higher multiple of a half-wavelength or a quarter-wavelength than the length of the outer resonant elements 116, 118, 120, and 122.

The inner resonant elements 108, 110, 112 and 114 are wound to form a helix with an initial diameter $d_1$, height $h_1$ and pitch angle $\alpha_1$. The outer resonant elements 116, 118, 120, 122 are wound to form a helix with an initial diameter $d_2$, height $h_2$ and pitch angle $\alpha_2$. The radiation pattern provided by each of the helices 102 and 104 is primarily a function of the length of the resonant elements 108, 110, 112, 114, 116, 118, 120 and 122 that make up the helices. The initial diameter, pitch angle and height of the helix do not influence the antenna's ability to transmit or receive. As a result, a multifilar antenna with at least four filars of the same fundamental length has broadly similar performance over a range of pitch angles and diameters.

Figure 7:
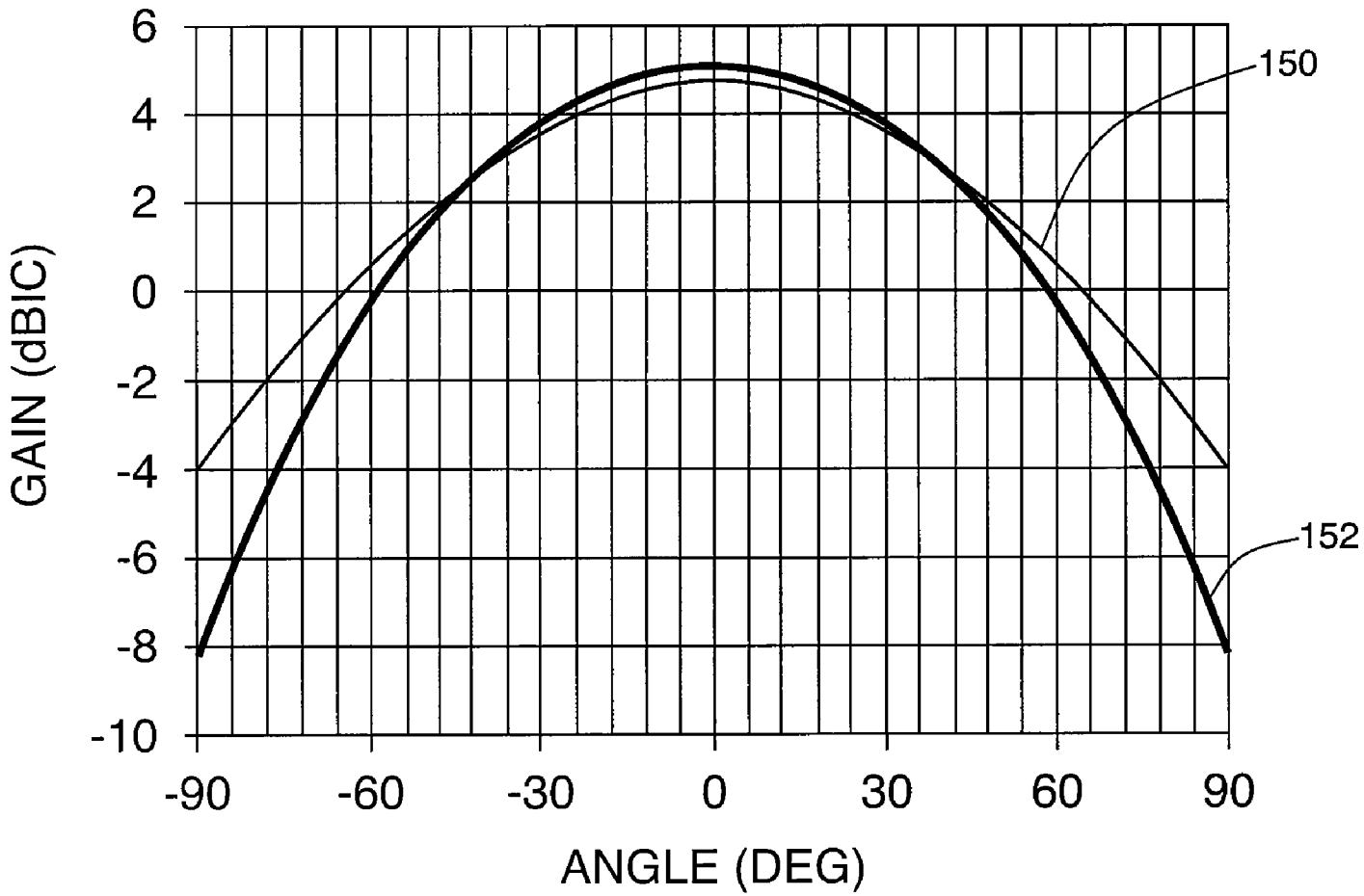
FIG. 7 is a graph showing the radiation pattern (referenced to circular polarization) of the dual polarized multifilar antenna shown in FIG. 3.

FIG. 7 shows the radiation pattern (referenced to circular polarization) of both helices 102 and 104 of a dual polarized multifilar antenna 100 with the following exemplary dimensions: the inner helix 102 has an initial diameter of 0.25 m, a pitch angle of 20.0° and 1.50 turns; the outer helix 104 has a diameter of 0.525 m, a pitch angle of 15.7° and 0.75 turns. Curve 150 represents the radiation pattern of the outer helix 104 and curve 152 represents the radiation pattern of the inner helix 102. As can be seen, peak gains of around 5 dBic (the antenna gain in decibels referenced to a circularly polarized, theoretical isotropic radiator) are achieved for both helices 102 and 104.

The initial diameter $d_1$ of the helix formed by the inner resonant elements 108, 110, 112, and 114 is less than the initial diameter $d_2$ of the helix formed by the outer resonant elements 116, 118, 120 and 122 such that the inner resonant elements 108, 110, 112 and 114 are concentric with the outer resonant elements 116, 118, 120 and 122. The initial helix diameters $d_1$ and $d_2$ are selected such that the two helices 102 and 104 have similar electrical performance with limited interference and coupling between them.

Selecting helix diameters $d_1$ and $d_2$ that are too similar creates the possibility that energy from one helix may be coupled into the other helix. This coupling is undesirable because it reduces the power that is transferred to/from free space by the helix. Furthermore, the coupling can adversely impact the radiation patterns of the helices 102 and 104. A reasonable goal is to have −15 dB coupling between the helices. The initial diameters $d_1$ and $d_2$ of the helices also cannot be so large that the resonant elements form only a small portion of the circumference of a defining cylinder. The initial diameters also should not be too small as increased electrical loss can arise. In an exemplary embodiment, the initial diameter of the outer helix $d_2$ is twice that of the initial diameter of the inner helix $d_1$.

In the exemplary embodiment shown in FIGS. 3 and 4 the helices 102 and 104 have constant diameters and are thus cylindrical in shape. Alternatively one or both of the helices 102 and 104 may have variable diameters that varies along the axis of the antenna. However, at all points the inner helix 102 must have a smaller diameter than the outer helix 104.

Figure 8:
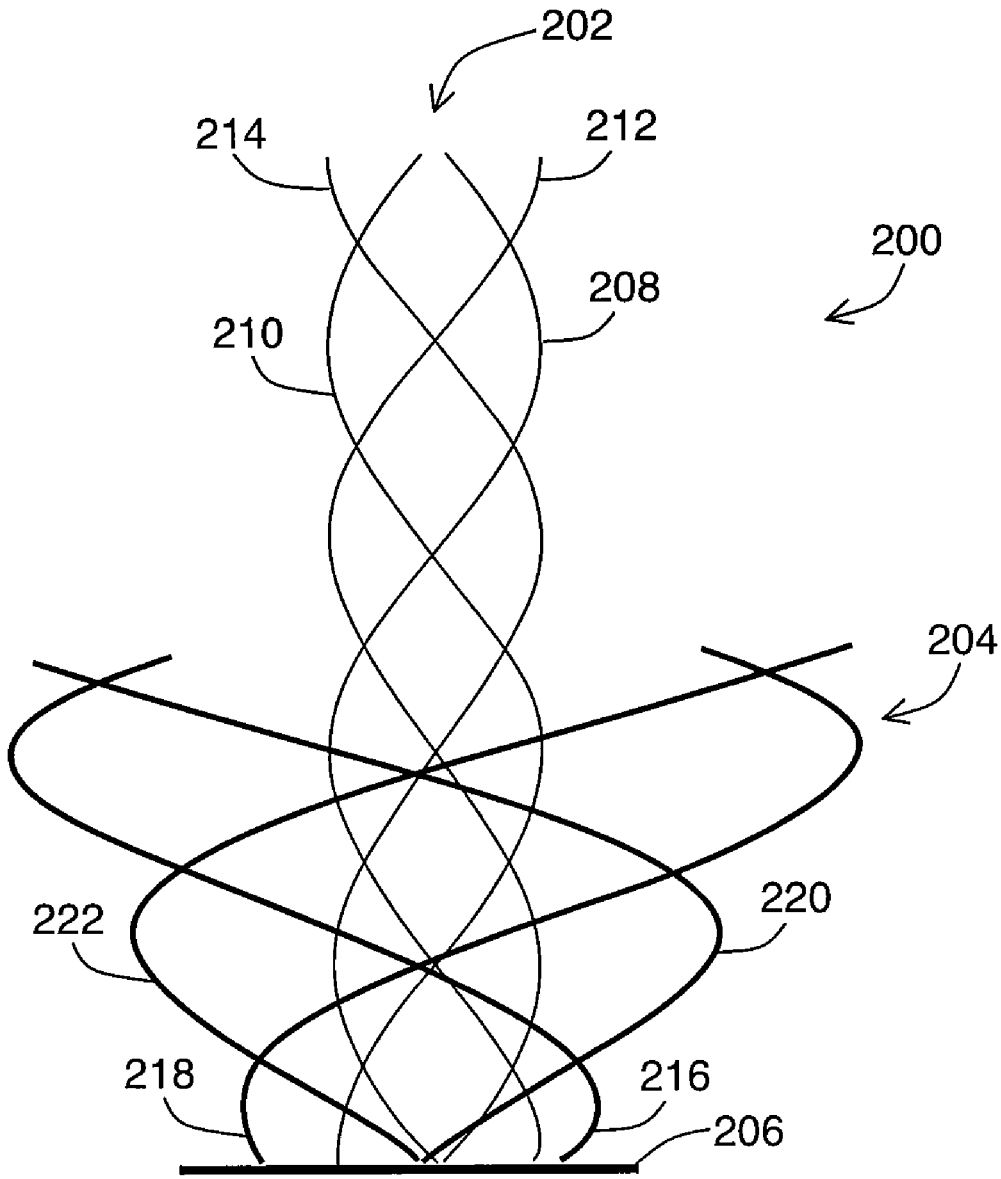
FIG. 8 is a side view of a dual polarized multifilar antenna where the outer helix has a variable diameter.

FIG. 8 shows a side view of an alternative embodiment of a dual polarized multifilar antenna 200 in which the outer helix resonant elements are wound with an increasing diameter. In the alternative embodiment the inner helix 202 is comprised of four resonant elements 208, 210, 212, 214 and the outer helix 204 is comprised of four resonant elements 216, 218, 220, 222. The inner resonant elements 208, 210, 212, 214 are cylindrically wound to form a helix with a constant diameter. However, the outer resonant elements 216, 218, 220, 222, are wound with an increasing diameter such that the outer helix 204 is cone or funnel shaped. The cylindrical helix embodiment may be used in applications, such as mobile device (i.e. cell phone) applications, where there is limited space for the antenna. The variable diameter helix embodiment may be used in satellite applications where there may be virtually unlimited space for the deployed antenna, but the volume of the stowed antenna is small.

The height $h_1$ of the inner helix 102 is greater than the height $h_2$ of the outer helix 104. This height difference is necessary to ensure that both helices 102 and 104 are operable at the same frequency (f) simultaneously. If the inner helix 102 were shorter than the outer helix 104 then the inner signal would necessarily propagate through the outer helix 104, to the detriment of it's electromagnetic performance.

Figure 9:
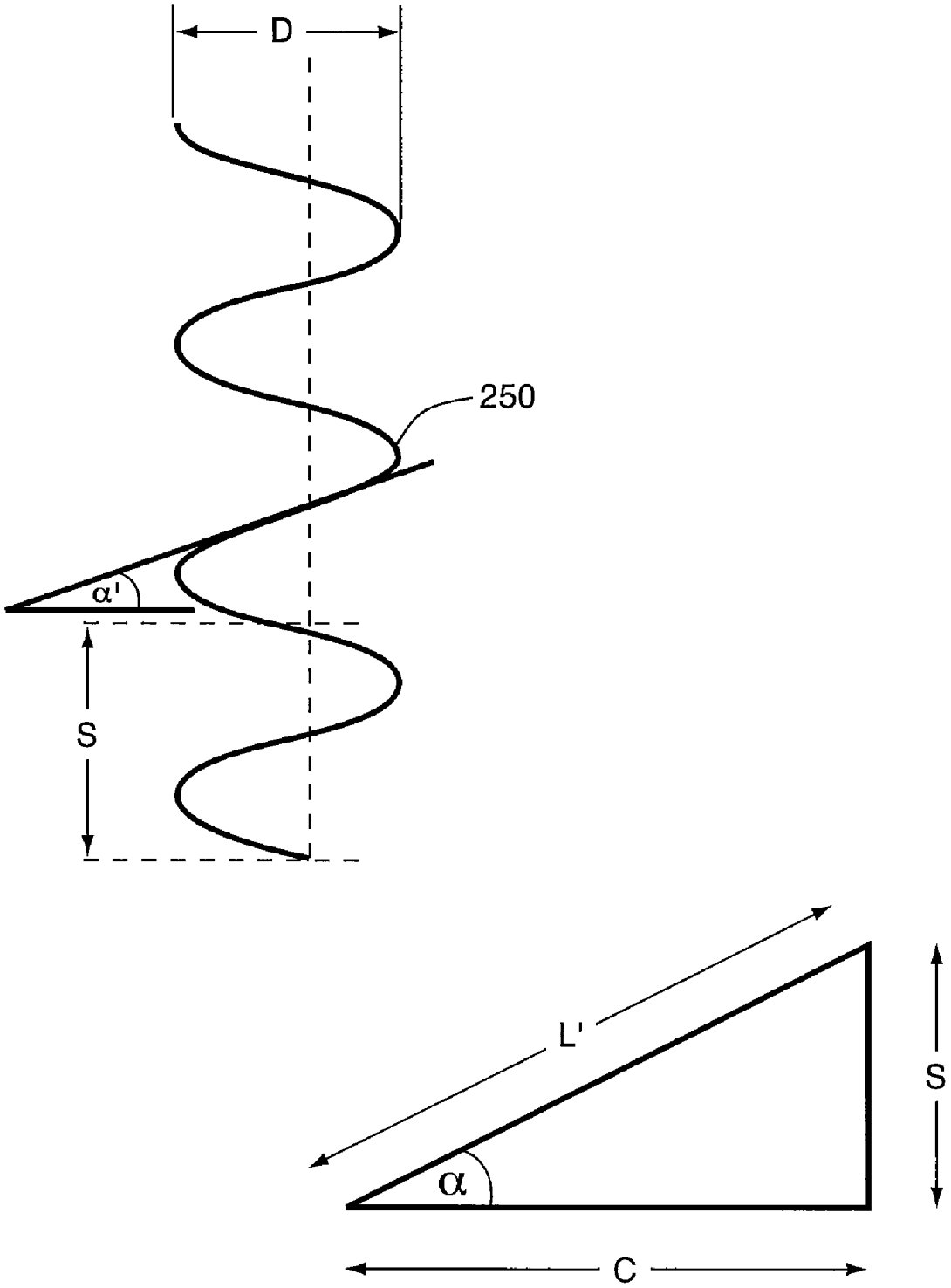
FIG. 9 is a side view of a single-wire helix, showing the basic dimensions of a helix.

The pitch angle $\alpha_1$ is the pitch of one turn of a resonant element. FIG. 9 is a side view of a one-wire helix 250 and is used to show the pitch angle of a helix. The parameter S is the turn spacing or the linear length of one turn of the helix. The parameter D is the diameter. If a single turn is stretched flat, the right triangle shown on the right side of FIG. 9 is obtained. The parameter C indicates the circumference of the turn, while L' indicates the length of wire to obtain a single turn. The angle $\alpha$ is the pitch of the helix and is equal to $\tan^{-1}$ (S/C).

The helical winding of all resonant elements 108, 110, 112, 114, 116, 118, 120 and 122 begins at the ground plane 106. The resonant elements of each helix 102 and 104 are physically spaced 360°/N apart. In the exemplary embodiment shown in FIG. 4, N=4 and therefore the resonant elements are spaced 90° apart. However, N can also be other values, which is discussed below.

Winding of the first helical resonant element 108 of the inner helix 102 begins at the first reference point 124. The winding of the second inner resonant element 118 begins at the second reference point 126, which is 90° from the first reference point 124. Winding of the third inner resonant element 110 begins at the third reference point 128, which is 90° from the second reference point 126, and 180° from the first reference point 124. Winding of the fourth inner resonant element 112 begins at the fourth reference point 130, which is 90° from the third reference point 128, 180° from the second reference point 126, and 270° from the first reference point 124. Similarly, winding of the resonant elements 116, 122, 118 and 120 forming the outer helix 104 start at reference points 132, 134, 136, 138 respectively.

Alternatively the windings of the outer helix 104 may be rotated about the helical axis, by an angle σ from the start of the windings of the inner helix 102 to provide more ground space for the connectors, matching and splitting circuitry. For example, when σ=45°, windings of the inner resonant elements 108, 110, 112 and 114 begin at 0°, 90°, 180° and 270°, respectively and windings of the outer resonant elements 116, 118, 120 and 122 begin at 45°, 135°, 225° and 315°, respectively.

Referring back to FIGS. 3 and 4, the inner resonant elements 108, 110, 112, 114 are wound in the same direction and the outer resonant elements 116, 118, 120, 122 are wound in the opposite direction so that one helix has right-hand circular polarization (RHCP) and the other helix has left-hand circular polarization (LHCP). It is electromagnetically irrelevant which helix has RHCP and which helix has LHCP. Accordingly, a dual polarized multifilar antenna with the inner helix 102 RHCP and the outer helix 104 LHCP will have the same performance as a dual polarized multifilar with the inner helix 102 LHCP and the outer helix 104 RHCP.

There are several known methods for determining the dimensions (diameter, height, pitch angle) of a multifilar helix. Two of the more common methods are trial and error and genetic division. With genetic division the Darwinian principle of natural selection is employed such that the most desirable parameters are successfully determined. The genetic division process begins by determining how many filars (resonant elements) the helix will have. Next approximately 1000 random N-filar helices are generated. The initial helices are then combined to form mutations. The N-filar helices are then compared against a fitness function to determine which antennas will be used for the next step. The fitness function typically includes the bandwidth, gain, polarization, radiation and input impedance of the ideal antenna. The process is then repeated for the antennas that meet the fitness function requirements. The complete process, i.e. mutation to comparison, is repeated until the iteration does not produce any significant improvements. The genetic division method is computationally complex and is thus typically performed by a computer.

The first ends 108*a*, 110*a*, 112*a*, 114*a*, 116*a*, 118*a*, 120*a*, and 122*a* of the resonant elements are connected via small holes in the ground plane 106 to coaxial cables which connect the resonant elements to the feed network which is comprised of a power splitter and a phase network. In one embodiment, the first ends 108*a*, 110*a*, 112*a*, 114*a*, 116*a*, 118*a*, 120*a*, and 122*a* of the resonant elements are each constrained in a dielectric sleeve that holds each element at the correct pitch angle from the ground plane 106. Alternatively, the first ends 108*a*, 110*a*, 112*a*, 114*a*, 116*a*, 118*a*, 120*a*, and 122*a* of the resonant elements are pin-jointed within a dielectric structure and a flexible wire leads to the connector.

The ground plane 106 is a plate or a series of plates made of electrically conductive material that provides mode matching between the coaxial cables and the resonant elements 108, 110, 112, 114, 116, 118, 120 and 122. Since the coaxial cable and the resonant element are fundamentally different forms of transmission lines, a mode mismatch occurs when the current flows from the coaxial cable to the resonant element. When there is a mode mismatch, a portion of the current can travel back down the outside of the coaxial cable, which will cause the coaxial cable to act as an antenna.

The ground plane 106 is one way of addressing this mode mismatch. That is, it allows the coaxial-to-resonant element junction to act as a proper balanced-to-unbalanced transformer (Balun). The ground plane 106 effectively pushes the current up the resonant element so that this energy is properly radiated by the helical antenna.

The ground plane 106 may have a circular shape, may be n-sided, may have a hole in the middle, may be an annulus or may even be N individual circular plates, one for each resonant element. The ground plane 106 must be large enough so that all of the energy is properly radiated by the helix. In general, a ground plane 106 that has a diameter between λ/10 and λ/20 greater than the initial diameter d2 of the outer helix 104 is sufficient. If the ground plane 106 is too small the effect of the coaxial-to-resonant element junction appears as current flow down the outside of the coaxial cable. Furthermore, the ground plane 106 may form a honeycomb sandwich structure or any other suitable structure.

The dual polarized multifilar antenna can operate in one of three modes. In the first mode the inner and outer helices 102 and 104 operate as independently circularly polarized antennas. In this mode each of the resonant elements of the helices 102 and 104 are fed in phase increments of 360°/N. For example, when N=4 the inner helix 102 is fed at 0°, 90°, 180° and 270°. Each helix 102 and 104 requires a 1:N power splitter and phasing circuits.

Conventionally, this splitting has been done with a microwave network, but it may also be done digitally, or at an intermediate frequency following up-conversion or down-conversion of the signals. There are various possibilities for the operation of the helices. For example, one helix can function as a transmit antenna and the other as a receive antenna. Alternatively, both helices 102 and 104 can function as transmit antennas. In a further alternative, both helices 102 and 104 can function as receive antennas.

In the second mode, the helices 102 and 104 operate as independent elliptically polarized antennas. In one embodiment there are two feed networks for each helix. The first network feeds the resonant elements in phase quadrature as described above. Thus, the resonant elements of a helix are fed signals of the same amplitude 360/N° apart. The second network feeds all of the resonant elements of a helix in phase. Thus, all the resonant elements of a helix are fed at the same time, with the same amplitude. What results is the vector addition of each signal on each resonant element. This mode may be used to minimize the interference from a jamming signal. An antenna controller would likely start out with pure circularly polarized waves and only add a second feed to improve the signal-to-noise (S/N) ratio. In an alternative embodiment the same result is achieved by feeding each of the eight resonant elements individually. This embodiment requires eight independent receivers, one for each resonant element.

In the third mode the two helices 102 and 104 are used to create one versatile adaptive antenna. This mode operates on the principle that LHCP and RHCP sources fed in phase with the same amplitude will produce a linearly polarized signal. This is a more effective method of rejecting a jamming signal. In this mode, the phase and amplitude are adjusted until the signal-to-jamming (S/J) ratio is maximized.

When synthesizing a radiation pattern by combining the individual patterns of two antennas, the 'effective origin of radiation' or 'phase center' must be known, and it should preferably not change with view angle or with frequency. This is because, at any viewing angle, the synthesized, combined, radiation (or energy density) is a function of the feed amplitudes and phases of the two individual antennas, as well as the location of their phase centers since that affects the total phase path length to the viewer. Certain synthesized patterns, such as in the present case, would be best done where the two phase centers are coincident, so a change of viewing angle does not impart a relative phase change between the individual sources. With two concentric antennas, the phase centers are likely to be close to their common axis, but perhaps displaced a bit in the axis direction. However, since the antennas are small compared to a wavelength this displacement is not especially significant, especially in the case of an end-fire antenna.

An example application of this third mode is ship-to-satellite communication. In ship-to-satellite communication the angle of received polarization can be arbitrary depending on the effects of the ionosphere (due to Faraday rotation). Therefore, the phase is adjusted until the antenna is linearly polarized in the direction of the ship's received signal. If there is a subsequent jamming signal that is to be avoided then the phase is further adjusted to optimize the S/N ratio. A problem may arise when the jamming signal and the ship's signal have the same polarization angle. However, the satellite can wait until it is in a position where the ship and the jamming signal are no longer at the same angle.

By placing one quadrifilar helix 102 concentrically within the other quadrifilar helix 104 over a common ground plane 106 a much more compact dual polarized helical antenna is realized. One practical use for this compact dual polarized quadrifilar antenna 100 is in satellite communication systems where the operating wavelength (λ) is large compared with the satellite dimensions. For example, most dual polarized antennas capable of operating at a wavelength (λ) of 1.85 meters would be too large to fit on a micro-satellite less than a meter in extent, but a dual polarized antenna as shown in FIGS. 3 and 4 would be sufficiently small for use in such an application.

Figure 10:
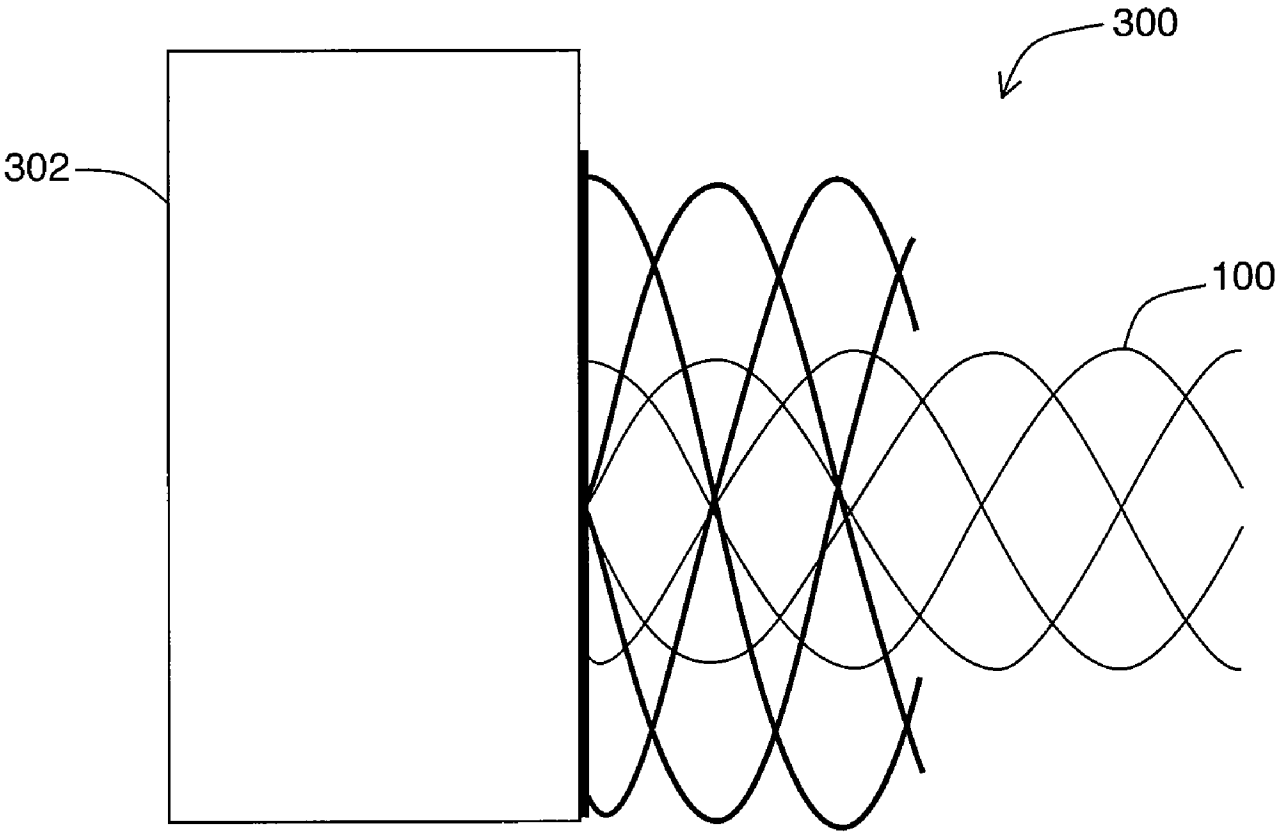
FIG. 10 is a side view of a satellite system comprising a dual polarized multifilar antenna as shown in FIG. 3.

FIG. 10 shows a side view of a satellite system 300 comprised of a satellite 302 and a dual polarized multifilar antenna 100 mounted to the satellite 302. In this application the ground plane 106 of the antenna 100 is bolted to the satellite 302. The ground plane 106 must be large enough such that there is room for the bolts in the area of the ground plane 106 where the current is zero. Accordingly an antenna 100 with eight individual ground planes is not practical for satellite applications. Smaller individual ground planes are more likely to be used in low frequency applications where the antenna is very large.

Figure 11:
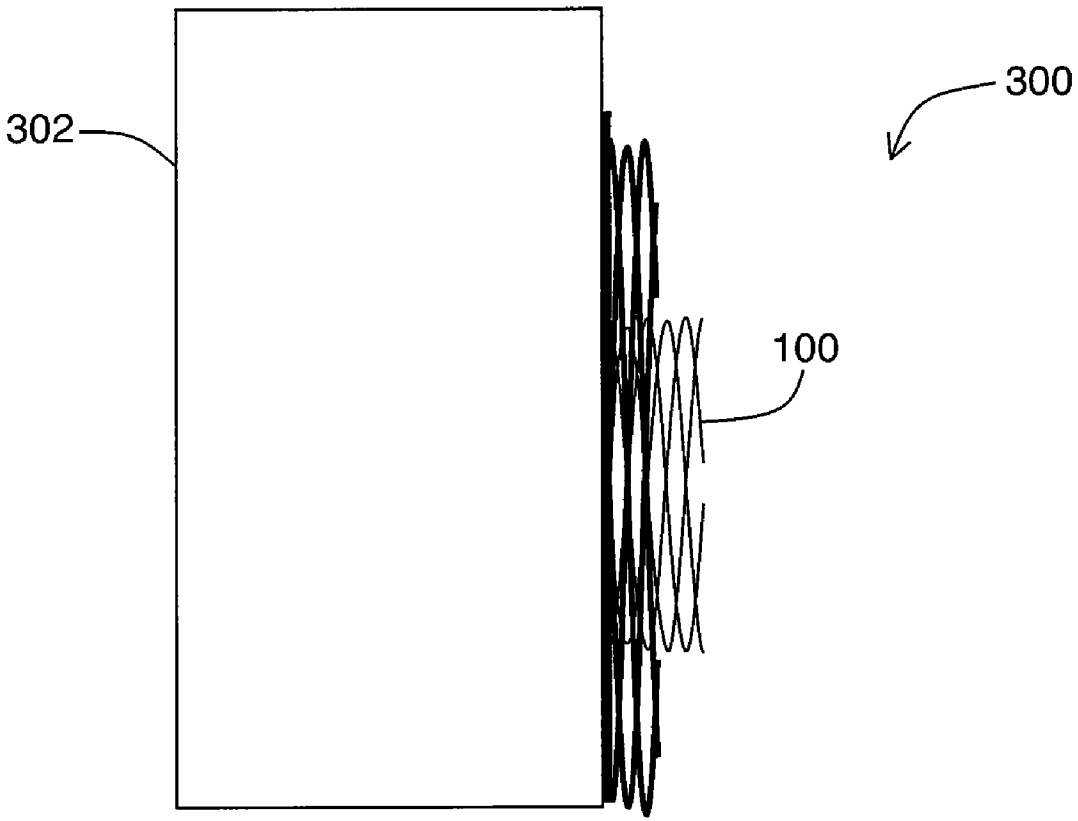
FIG. 11 is a side view of the satellite system shown in FIG. 10 with the dual polarized multifilar antenna compressed or stowed.

In addition to being compact in its operational state, the dual polarized quadrifilar antenna 100 can also be compressed or collapsed, like a spring, into a small volume for stowage. FIG. 11 shows a side view of the satellite system 300 shown in FIG. 10 with a compressed dual polarized multifilar antenna 100. The compression and decompression may be performed by a mechanism, or manually. In one embodiment strings are used to hold the antenna 100 in its stowed position. The strings are made of a material, such as Kevlar or Astroquartz, which does not degrade rapidly in space. Furthermore the material is woven like wool to form a rope to avoid the problems caused by free electrons in orbit. In space, electrons can build up on unwoven material, such as plastic, to form a charge that can cause a current spike in the antenna 100. With a woven cloth enhanced lateral conduction is achieved, which is where the cloth safely takes the charge down to ground, due to the presence of electrons trapped within the weave.

The resonant elements 108, 110, 112, 114, 116, 118, 120, 122 may be wound such that when the strings are released these resonant elements will form helices with the desired heights. In this case, when the antenna is deployed, the strings are no longer required. However, if the resonant elements 108, 110, 112, 114, 116, 118, 120, 122 are wound such that if the strings are released the helices will be taller than required, the strings can be used to hold the resonant elements at the correct height. Deployment can either be restrained by a mechanism that reels out the strings slowly or the strings can be cut. The strings can be cut with a pyrotechnic cutting device or a hot edge/knife cutter.

For the helices 102 and 104 to be compressible the resonant elements 108, 110, 112, 114, 116, 118, 120, 122 must be made of a spring-like material such as high-carbon steel, spring-grade stainless steel (e.g. type 304) or beryllium-copper. Also, compressible helices should be limited in size as it is difficult to successfully deploy helices with a length to diameter ratio greater than 4:1 unless additional (or special) restraints are used.

The dual polarized quadrifilar antenna 100 may also be made more rugged by placing it in a housing. The housing can be made of plastic or any other non-conductive material that is relatively lossless at the operating frequency (f). Such a rugged dual polarized quadrifilar antenna may be used in mobile or transportable communication systems.

Figure 12:
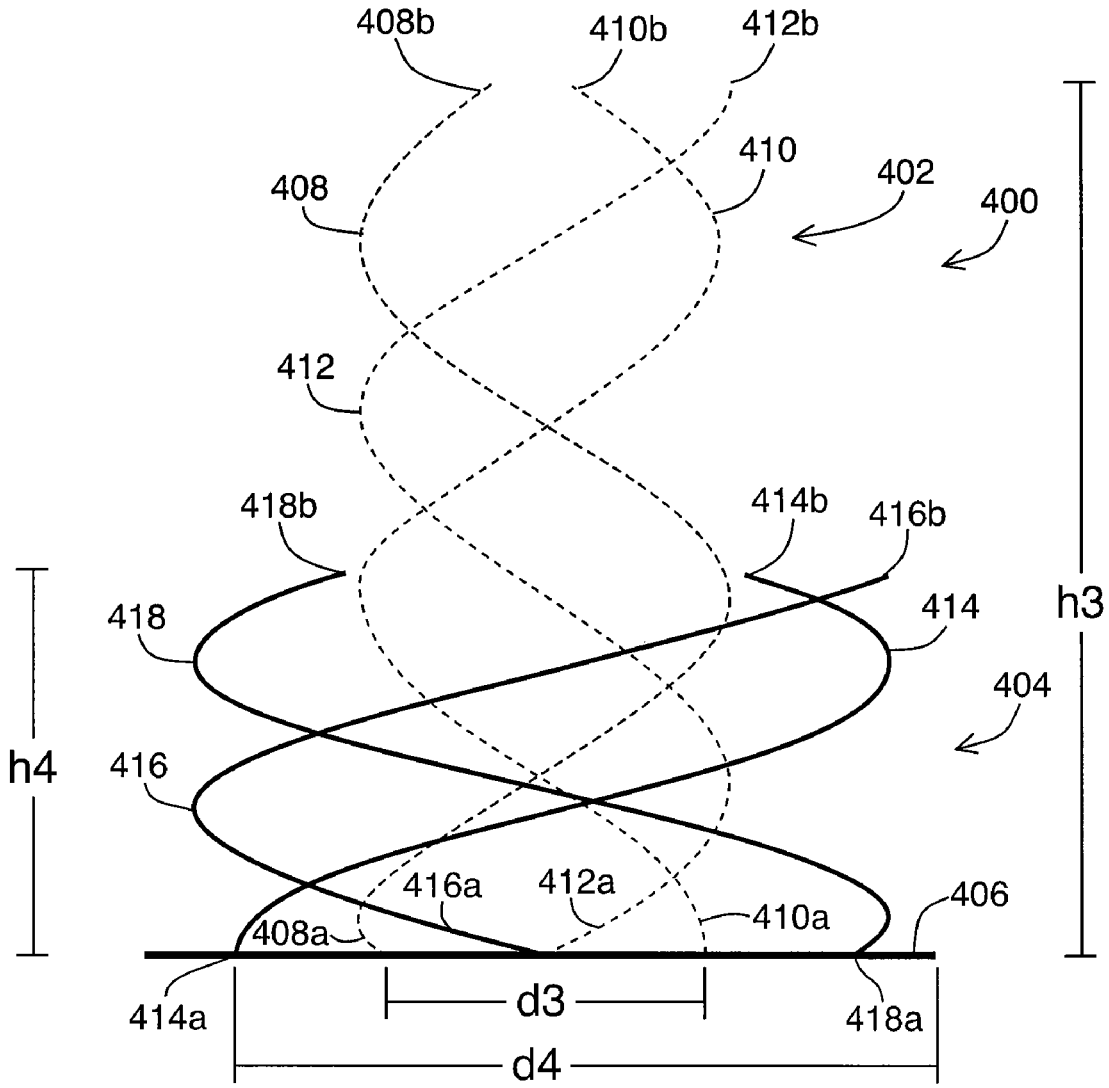
FIG. 12 is a side view of an exemplary embodiment of a dual polarized trifilar antenna.
Figure 13:
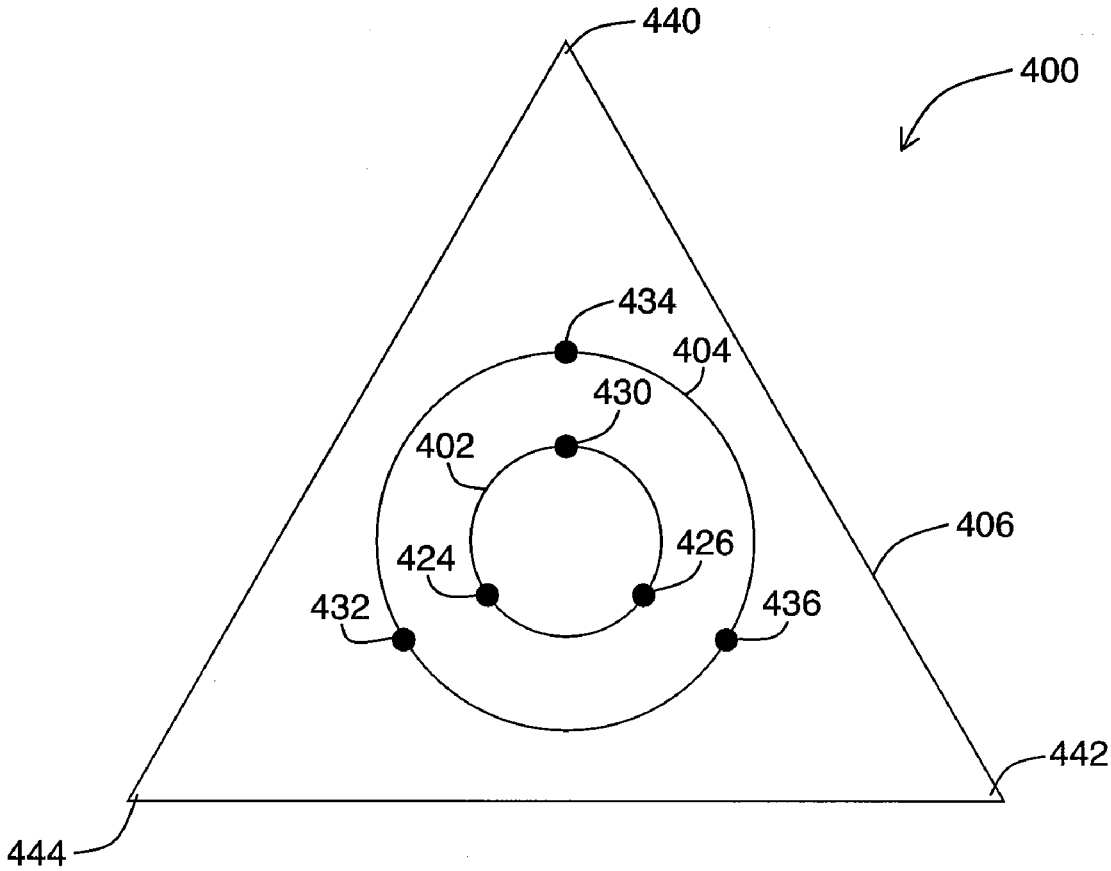
FIG. 13 is a top view of an exemplary embodiment of a dual polarized trifilar antenna.

Reference is now made to FIGS. 12 and 13 that show a side view and a top view, respectively, of an exemplary embodiment of a dual polarized trifilar antenna 400. The antenna 400 includes an inner trifilar helix 402, an outer trifilar helix 404 and a common ground plane 406. The inner helix 402 is placed concentrically within the outer helix 404 over the common ground plane 406. The inner and outer helices 402 and 404 form independent oppositely polarized antennas that are simultaneously operable at the same frequency (f).

It should be understood that while a common reflector is utilized in the present embodiment as the common ground plane 406, various other devices can be used in place of the common ground plane 406. For example, a balanced feed network including a three-phase power splitter and a three-phase balanced transmission line can be configured so that the inner trifilar helix 402 and the outer trifilar helix 404 are properly fed can be used instead.

Also, in some applications, it should be understood that it may be convenient to feed either the inner or outer trifilar helix 402 or 404 in one manner, and the other of the inner or outer trifilar helix 402 or 404 in another manner. For instance, if there was tightly restricted space around the base of the outer trifilar helix 404, it can be fed using a three-wire feed, while the inner trifilar helix 402 can be fed with a conventional ground plane. The reverse can also apply.

The trifilar helices 402 and 404 are each comprised of three identical resonant elements or "filars". While the filars are referred to as "resonant" elements it is not essential that the elements be strictly resonant; it is sufficient if they are approximately resonant or within ±20% of resonance. In the exemplary embodiment shown in FIGS. 12 and 13, the helices 402 and 404 are each comprised of three resonant elements 408, 410, 412 and 414, 416, 418 respectively. Each resonant element has a first end 408*a*, 410*a*, 412*a*, 414*a*, 416*a*, 418*a*, and a second end 408*b*, 410*b*, 412*b*, 414*b*, 416*b*, 418*b*. The resonant elements 408, 410, 412, 414, 416 and 418 can be implemented as wires made out of electrically conductive material such as copper, copper-plated steel, beryllium-copper, plated plastic of composite material, or conductive polymers, and the like.

The resonant elements 408, 410, 412, 414, 416 and 418 can have a constant gauge or can be tapered. The gauge of the resonant elements 408, 410, 412, 414, 416 and 418 is dictated by two constraints: (1) the resonant elements must be of a sufficient gauge so as not to incur excessive resistive losses; and (2) the resonant elements must be thin enough so that there is not an unacceptable degree of capacitive coupling that would render the antenna inoperable.

As with the N-filar embodiments described above, where N was at least four, the length of the resonant elements is dictated approximately by the frequency (f) at which the antenna operates and whether the antenna is a short or open-circuited helical antenna. In an open-circuited antenna the second ends of the resonant elements 408*b*, 410*b*, 412*b*, 414*b*, 416*b*, 418*b* are open-circuited as shown in FIG. 12. In a short-circuited antenna, the second ends of the resonant elements 408*b*, 410*b*, 412*b*, 414*b*, 416*b*, 418*b* are short-circuited to each other via conductive elements.

For an open-circuited trifilar antenna the lengths of the individual resonant elements 408, 410, 412, 414, 416, and 418 are approximately equal to a multiple of half-wavelengths ($\lambda/2$) where the wavelength ($\lambda$) is inversely proportional to the operating frequency (f). Accordingly, the smallest open-circuited trifilar antenna operating at 300 MHz (a wavelength ($\lambda$) of 1 meter) requires resonant element lengths of approximately 0.5 meters. For a short-circuited trifilar antenna the length of the resonant elements is approximately equal to a multiple of quarter wavelengths ($\lambda/4$). A $\lambda/4$ short-circuited antenna would clearly be a smaller antenna than a $\lambda/2$ open-circuited antenna, but the short-circuited antenna would require additional parts and joints to connect the resonant elements and would have less gain. The resonant element lengths are not exact multiples of a half-wavelength ($\lambda/2$) or a quarter-wavelength ($\lambda/4$) due to the fact that the wave will propagate along a resonant element at less than the speed of light due to the presence of the other resonant element and the coupling of energy to the free-space wave.

In the exemplary embodiment shown in FIGS. 12 and 13, the length of the resonant elements 408, 410, 412, 414, 416 and 418 is approximate equal to a half-wavelength ($\lambda/2$). In the case where both the inner and outer resonant elements are of equal nominal length, their performance (i.e. radiation pattern and gain profile) will be similar if not very closely related. However, it is not necessary that the length of the inner resonant elements 408, 410, and 412 be equal to the length of the outer resonant elements 414, 416, and 418. The length of the inner resonant elements 408, 410 and 412 may be a higher multiple of a half-wavelength or a quarter-wavelength than the length of the outer resonant elements 414, 416 and 418.

The inner resonant elements 408, 410 and 412 are wound to form a helix with an initial diameter $d_3$, height $h_3$ and pitch angle $\alpha_3$. The outer resonant elements 414, 416, 418 are wound to form a helix with an initial diameter $d_4$, height $h_4$ and pitch angle $\alpha_4$. The radiation pattern provided by each of the helices 402 and 404 is primarily a function of the length of the resonant elements 408, 410, 412, 414, 416, 418 that make up the helices. The initial diameter, pitch angle and height of the helix do not influence the antenna's ability to transmit or receive. As a result, a trifilar antenna with three filars of the same fundamental length has broadly similar performance over a range of pitch angles and diameters.

The initial diameter $d_3$ of the helix formed by the inner resonant elements 408, 410, 412, is less than the initial diameter $d_4$ of the helix formed by the outer resonant elements 414, 416, 418 such that the inner resonant elements 408, 410, 412 are approximately concentric with the outer resonant elements 414, 416, 418. The initial helix diameters $d_3$ and $d_4$ are selected such that the two helices 402 and 404 have similar electrical performance with limited interference and coupling between them.

Selecting helix diameters $d_3$ and $d_4$ that are too similar creates the possibility that energy from one helix may be coupled into the other helix. This coupling is undesirable because it reduces the power that is transferred to/from free space by the helix. Furthermore, the coupling can adversely impact the radiation patterns of the helices 402 and 404. A reasonable goal is to have −15 dB coupling between the helices. The initial diameters $d_3$ and $d_4$ of the helices also cannot be so large that the resonant elements form only a small portion of the circumference of a defining cylinder. The initial diameters also should not be too small as increased electrical loss can arise. In a preferred embodiment the initial diameter of the outer helix $d_4$ is twice that of the initial diameter of the inner helix $d_3$.

In the exemplary embodiment shown in FIGS. 12 and 13 the helices 402 and 404 have constant diameters and are thus cylindrical in shape. Alternatively one or both of the helices 402 and 404 may have variable diameters. However, at all points the inner helix 402 must have a smaller diameter than the outer helix 404.

The height $h_1$ of the inner helix 402 is greater than the height $h_2$ of the outer helix 404. This height difference is necessary to ensure that both helices 402 and 404 are operable at the same frequency (f) simultaneously. If the inner helix 402 were shorter than the outer helix 404 then the inner signal would necessarily propagate through the outer helix 404.

The helical winding of all resonant elements 408, 410, 412, 414, 416, and 418 begins at the ground plane 406. The resonant elements of each helix 402 and 404 are physically spaced 120° apart. The winding of the first helical resonant element 408 of the inner helix 402 begins at the first reference point 424. The winding of the second inner resonant element 410 begins at the second reference point 426, which is 120° from the first reference point 424. Winding of the third inner resonant element 412 begins at the third reference point 428, which is 120° from the second reference point 426, and 240° from the first reference point 424. Similarly, the winding of the resonant elements 414, 416, 418 forming the outer helix 404 start at reference points 432, 434, 436 respectively. These angles refer to mechanical angles or relative displacement between the resonant elements of a given helical antenna and can also represent the phase differences of the electrical signals that are fed to the resonant elements of a given helical antenna.

Alternatively the windings of the outer helix 404 may be rotated about the helical axis, by an angle a from the start of the windings of the inner helix 402 to provide more ground space for the connectors, matching and splitting circuitry. For example, where $\sigma$=60°, windings of the inner resonant elements 408, 410, 412 begin at 0°, 120° and 240°, respectively and windings of the outer resonant elements 414, 416, 418 begin at 60°, 180° and 300° respectively.

The inner resonant elements 408, 410, 412 are wound in the same direction and the outer resonant elements 414, 416, 418 are wound in the opposite direction so that one helix has right-hand circular polarization (RHCP) and the other helix has left-hand circular polarization (LHCP). If some degree of electrical separation were employed, then the helices can be wound in the same direction. It is electromagnetically irrelevant which helix has RHCP and which helix has LHCP. Accordingly, a dual polarized trifilar antenna with the inner helix 402 RHCP and the outer helix 404 LHCP will have the same performance as a dual polarized trifilar antenna with the inner helix 402 LHCP and the outer helix 404 RHCP.

The ground plane 406 may have any shape, including, but not limited to a triangular shape, a circular shape, may be n-sided, may have a hole in the middle, may be an annulus or may even be N individual circular plates, one for each resonant element. The ground plane 406 must be large enough so that all of the energy is properly radiated by the helix. In general, a ground plane 406 that has a diameter between $\lambda/10$ and $\lambda/20$ greater than the initial diameter d4 of the outer helix 404 is sufficient. If the ground plane 406 is too small the effect of the coaxial-to-resonant element junction appears as current flow down the outside of the coaxial cable. Furthermore, the ground plane 406 may form a honeycomb sandwich structure or any other suitable structure.

In comparison with embodiments having four or more filars per helix, the lower number of filars in the trifilar embodiment leads to a lesser degree of coupling between the two helices 402 and 404. In addition, the dual antenna configurations described herein that use quadrifilar or trifilar antennas have been seen to have substantially similar gain and radiation patterns.

Figure 14:
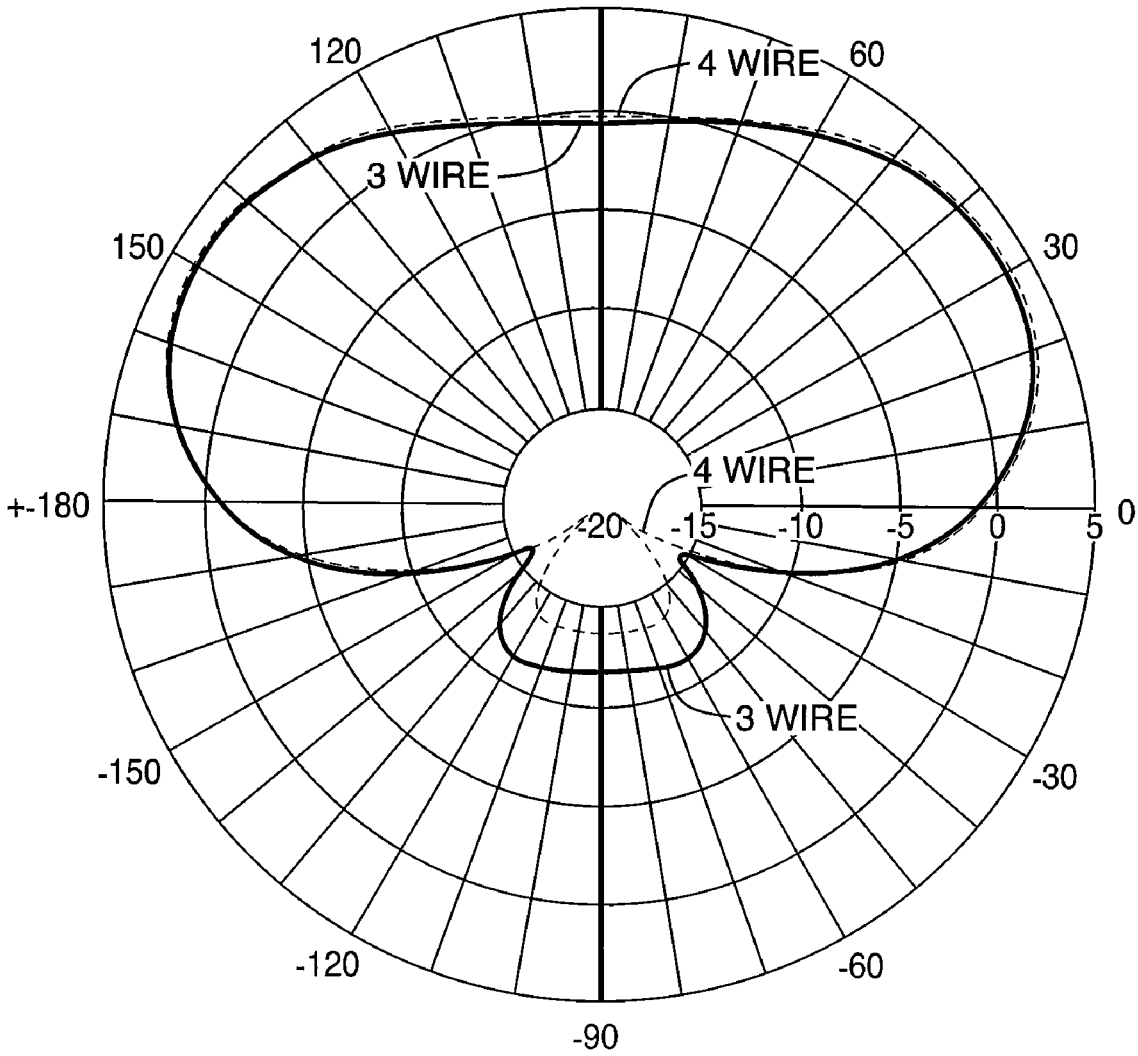
FIG. 14 illustrates simulation results showing the radiation pattern for quadrifilar and trifilar helical antennas having similar wire geometry.
Figure 15:
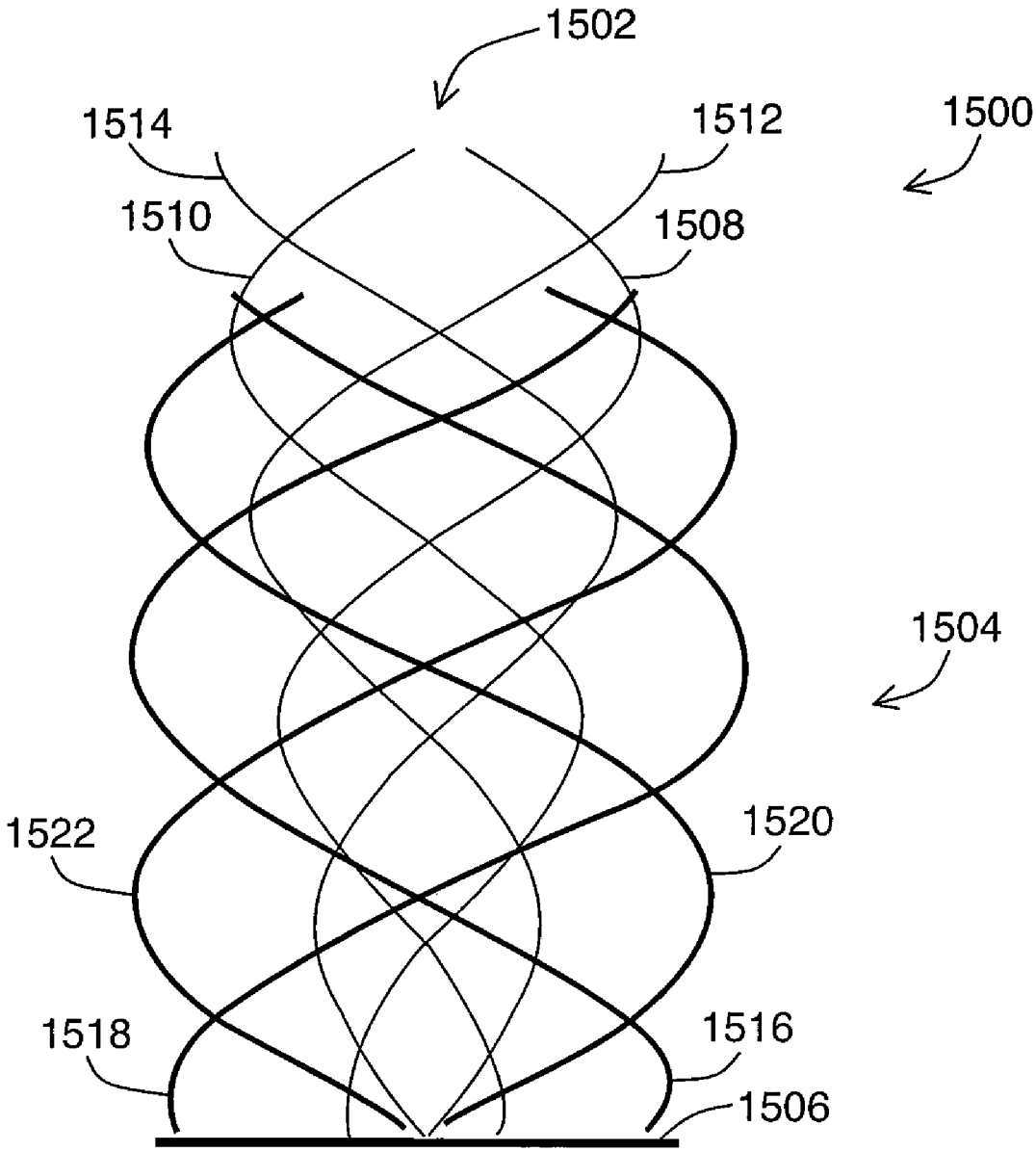
FIG. 15 is a side view of a dual polarized multifilar antenna where the inner helix has a variable diameter.
Figure 16:
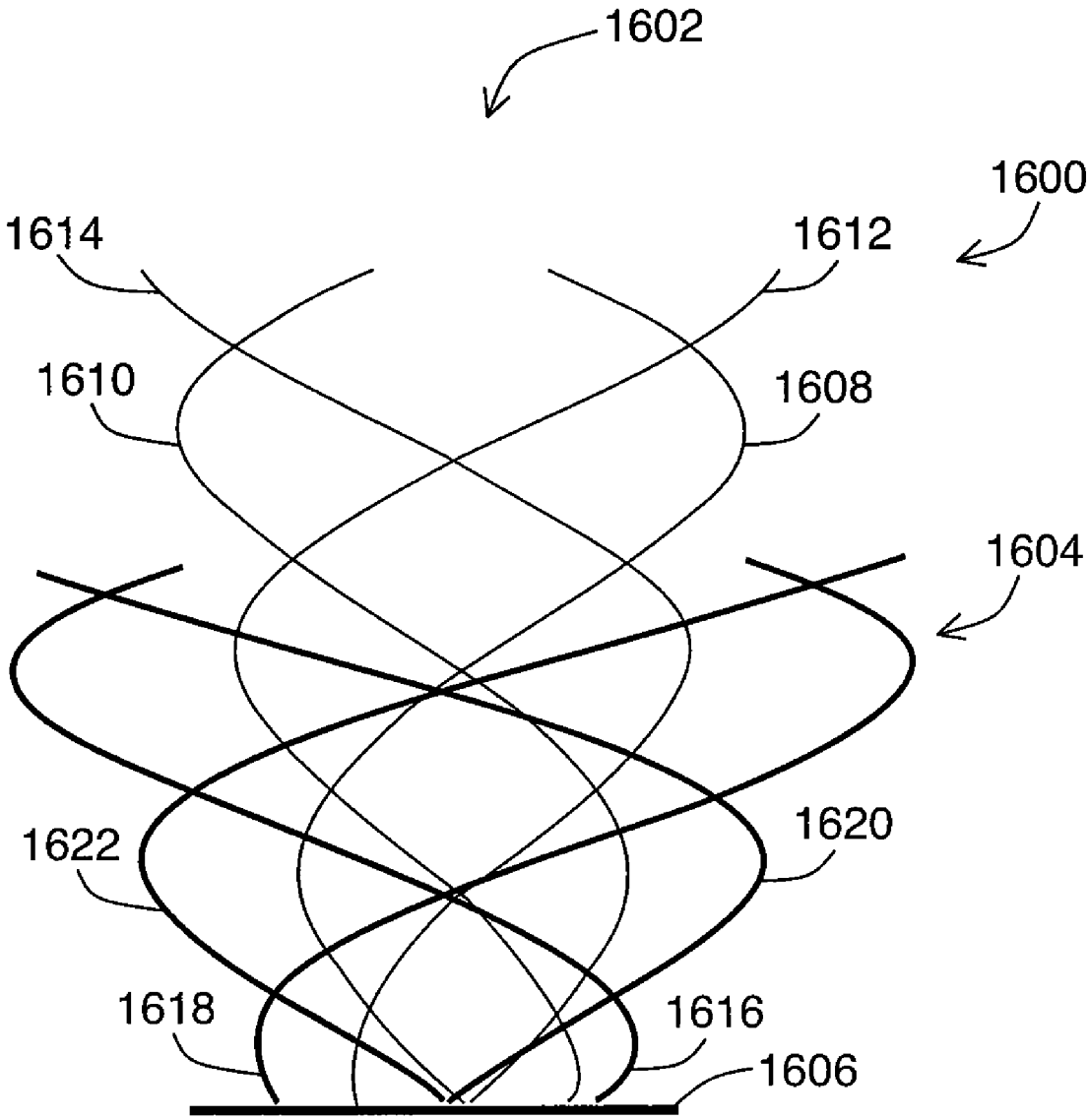
FIG. 16 is a side view of a dual polarized multifilar antenna where both the inner helix and outer helix have a variable diameter.

For example, referring now to FIG. 14, shown therein is an illustration of simulation results showing the radiation pattern for quadrifilar and trifilar helical antennas having identical wire geometry. Both antennas have 1 turn, are 2 meters long, and have a diameter of 0.25 meters. These dimensions were just chosen as an example. For both antennas, there is no ground plane and the wires are fed from a star-like configuration at the base. In the simulation, the antennas radiated a 162 MHz signal. The radiation pattern from the quadrifilar antenna is indicated by the text "4-wire" and the radiation pattern from the trifilar antenna is indicated by the text "3-wire". The radiation patterns virtually overlay one another. These results can be extrapolated to the dual polarized antenna case. These simulation results, and others shown herein, can be obtained using a version of the Lawrence-Livermore Numerical Electromagnetic Code 'NEC' as provided by Nittany Scientific of Riverton, UK, or the Concerto modeler, which is a Finite-difference-time-domain modeler made by Vector Fields of the UK.

Multiple satellites are frequently launched on a single rocket; a common technique for accommodating multiple satellites on a rocket launcher is to fit multiple triangular satellites together like "slices of a pie". Mounting a dual polarized multifilar antenna having four or more filars per helix on a triangular platform may result in wasted surface area and therefore excess unnecessary weight, and may increase the degree of complexity of the mounting equipment. In the exemplary embodiment of the dual polarized trifilar antenna shown in FIG. 13, the connection points of the helices can be arranged to utilize the space provided by the triangular surface more efficiently than multifilar helices having four or more filars. For example, the reference points 424, 426, 430, 432, 434, 436 can be located in the regions of the vertices 440, 442, 444 of the triangle. The components of the three-phase feed, and any stowing equipment associated with each of the first ends can be located near each respective vertex. This allows one to maximize the diameter of the outer trifilar antenna. The inner trifilar antenna can then be mounted in any desired fashion; for instance the resonant elements can start at the same angular positions as those of the outer trifilar antenna, or can be displaced by 60 degrees, or can be varied in another way. The diameters of the outer helical antenna can also be selected so that the outer helical antenna is larger than the surface area of the antenna; in this case, the resonant elements of the outer helical antenna can be compressed in the circumferential and radial directions when stowed prior to deployment.

The dual polarized multifilar antenna can operate in one of three modes. In the first mode the inner and outer helices 402 and 404 operate as independently circularly polarized antennas. In this mode each of the resonant elements of the helices 402 and 404 are fed in phase increments of 120°. For example, the inner helix 402 is fed at 0°, 120° and 240°. In general, each helix 402 and 404 is provided with a three-phase feed that can include a 1:3 power splitter and appropriate phasing circuits.

Conventionally, this splitting has been done with a microwave network, but it may also be done digitally, or at an intermediate frequency following up or down-conversion of the signals. There are various possibilities for operation of the two helical antennas 402 and 404. For example, one helix can function as a transmit antenna and the other as a receive antenna. Alternatively, both helices 402 and 404 can function as transmit antennas. In another alternative, both helices 402 and 404 can function as receive antennas.

In the second mode, the helices 402 and 404 operate as independent elliptically polarized antennas. In at least one implementation, there are two feed networks for each helix. The first network feeds the resonant elements in phase quadrature as described above. Thus, the resonant elements of a helix are fed signals of the same amplitude 120° apart. The second network feeds all of the resonant elements of a helix in phase. Thus, all the resonant elements of a helix are fed at the same time, with the same amplitude. The result is the vector addition of each signal on each resonant element. This mode may be used to minimize the interference from a jamming signal. An antenna controller would likely start out with pure circularly polarized waves and only add a second feed to improve the signal-to-noise (S/N) ratio. In an alternative embodiment the same result is achieved by feeding each of the eight resonant elements individually. This embodiment requires six independent receivers, one for each resonant element.

In the third mode the two helices 402 and 404 are used to create one versatile adaptive antenna. This mode operates on the principle that LHCP and RHCP sources fed in phase with the same amplitude will produce a linearly polarized signal. This is a more effective method of rejecting a jamming signal. In this mode, the phase and amplitude are adjusted until the signal-to-jamming (S/J) ratio is maximized.

In an alternative embodiment, the two helical antennas can have different number of wires. For example, in one exemplary embodiment, the inner helical antenna can be a trifilar antenna and the outer helical antenna can be a quadrifilar antenna. In another exemplary embodiment, the inner helical antenna can be a quadrifilar antenna and the outer helical antenna can be a trifilar antenna. Other combinations are also possible.

It should also be understood that in all of the embodiments described herein, the inner and outer helical antennas can operate at the same frequency or at different frequencies while carrying similar or different information in both cases.

While certain features of the exemplary embodiments contained herein have been illustrated and described, many modifications, substitutions, changes, and equivalents will now occur to those of ordinary skill in the art. It should be understood that these various modifications can be made to the embodiments described and illustrated herein, without departing from the embodiments, the general scope of which is defined in the appended claims.

The invention claimed is:

1. An antenna comprising:

a common ground plane;

a first set of N approximately resonant elements associated with the common ground plane, each of said first set of approximately resonant elements having a length l2 and wound to form a first helix with an initial diameter d2 and a height h2; and a second set of N approximately resonant elements associated with the common ground plane, each of said second set of approximately resonant elements having a length l1 and wound in the opposite direction to the first set of approximately resonant elements to form a second helix that is centrally disposed within the first helix, and has an initial diameter dl and a height h1 where d1 is less than d2 and h1 is greater than h2, wherein the length l2 of the first set of approximately resonant elements is about equal to the length l1 of the second set of approximately resonant elements, and wherein the first and second helices are simultaneously operable at the same frequency (f).

2. The antenna of claim 1, wherein N is greater than or equal to three.

3. The antenna of claim 1, wherein N is equal to three and the first and second helices are trifilar helices.

4. The antenna of claim 1, wherein N is equal to four and the first and second helices are quadrifilar helices.

5. The antenna of claim 1, wherein the approximately resonant elements each have a first end and a second end and the second ends are open-circuited.

6. The antenna of claim 1, wherein the approximately resonant elements each have a first end and a second end and the second ends are short-circuited to one another by conductors.

7. The antenna of claim 1, wherein the length of all approximately resonant elements is about a half-wavelength ($\lambda/2$).

8. The antenna of claim 1, wherein the length of all approximately resonant elements is about a quarter-wavelength ($\lambda/4$).

9. The antenna of claim 1, wherein the length l2 of the first approximately resonant elements is greater than the length l1 of the second approximately resonant elements.

10. The antenna of claim 1, wherein the first and second set of approximately resonant elements are cylindrically wound to form cylinders with a constant diameters.

11. The antenna of claim 1, wherein the first set of approximately resonant element are cylindrically wound to form a cylinder with a constant diameter and the second set of approximately resonant elements are wound to form a structure with a variable diameter.

12. The antenna of claim 1, wherein the first set of approximately resonant elements are wound to form a first structure with a variable diameter and the second set of approximately resonant elements are wound to form a second structure with a variable diameter.

13. The antenna of claim 1, wherein the first and second helices function as independently circularly polarized antennas.

14. The antenna of claim 1, wherein the first and second helices function as a single adaptive antenna.

15. The antenna of claim 1, wherein the first and second helices are compressible into a small volume.

16. The antenna of claim 1, wherein the common ground plane comprises at least one balanced feed network having a set of N feed elements.

17. The antenna of claim 1, wherein the common ground plane is a shared reflector.

18. The antenna of claim 1, wherein the second set of approximately resonant element are cylindrically wound to form a cylinder with a constant diameter and the first set of approximately resonant elements are wound to form a structure with a variable diameter.

19. A dual polarized multifilar antenna comprising:

a ground plane;

a first set of N resonant elements coupled to the ground plane and wound to form a first helical antenna; and a second set of M resonant elements coupled to the ground plane and wound in an opposite direction to the first set of resonant elements to form a second helical antenna, wherein, the first and second helical antennas are concentric, have different heights and diameters, the resonant elements of both helical elements have similar lengths, and the helical antennas are operable at substantially similar frequencies simultaneously.

20. The antenna of claim 19, wherein N and M are integers with values greater than or equal to three.

* * * * *